United States Patent [19]

Sanders

[11] Patent Number: 4,618,909

[45] Date of Patent: Oct. 21, 1986

[54] STATIC DISCHARGE DEVICE

[76] Inventor: James L. Sanders, 12235 Crawford Rd., Omaha, Nebr. 68144

[21] Appl. No.: 812,459

[22] Filed: Dec. 23, 1985

[51] Int. Cl.[4] ..... H05F 3/00

[52] U.S. Cl. ..... 361/212; 361/220

[58] Field of Search ..... 361/212, 220, 225, 235, 361/221, 222, 223, 224; 34/1, 133

[56] References Cited

U.S. PATENT DOCUMENTS

| | | | |
|---|---|---|---|
| 1,508,400 | 1/1921 | Kronmiller . | |
| 1,977,991 | 10/1934 | Hawkins | 361/212 |
| 2,375,304 | 5/1945 | Kilduff . | |
| 2,568,068 | 9/1951 | Harpman . | |
| 3,161,479 | 12/1964 | Biderman . | |
| 3,643,349 | 2/1972 | Zenz . | |
| 3,991,479 | 11/1976 | Dionne . | |
| 4,190,874 | 2/1980 | Pasold . | |

*Primary Examiner*—L. T. Hix
*Assistant Examiner*—Douglas S. Lee
*Attorney, Agent, or Firm*—E. Robert Newman

[57] ABSTRACT

A static discharge device including a band of material which tends to give up electrons, mounted on the exterior circumference of a clothes dryer drum. A layer of material tending to tear away electrons is affixed to the drum-adjacent face of a contact shoe which is mounted on a side wall of the dryer and biased to frictionally contact the band. The contact shoe is electrically grounded, so that the electrons which are collected by the layer of material and then transmitted to the contact shoe are continuously removed to ground.

7 Claims, 3 Drawing Figures

STATIC DISCHARGE DEVICE

TECHNICAL FIELD

This invention relates generally to static discharge devices, and more particularly to means for continuously discharging the static charge build-up in clothes dryers and similar appliances.

BACKGROUND

Static electricity results when two specific types of materials—one having atoms which tend to part with electrons to adjacent atoms and the other having atoms which tend to tear electrons away from adjacent atoms—are rubbed together. Such materials will thereby take on opposite charges as friction causes electrons to be transferred from the first material to the other. Since charges of opposite polarity attract each other, the amount of "cling" between such materials increases as the friction continues.

The friction between clothes as they tumble within a rotating dryer drum, and between the clothes and the drum's inner surface, will cause a static charge to build in this same fashion. As the various items of clothing become oppositely charged, they will tend to cling to each other and become difficult to separate. Another undesirable effect of such static is that it also attracts and causes lint to cling to the clothes.

Thus, it is desirable that these charges be neutralized or discharged before removing the clothes from the dryer. It is even more desirable to eliminate the charges as they occur, so that even small charges will be dissipated.

In the past, devices for neutralizing static charges have included magnets placed within the dryer so that a magnetic field would project into the drum area. The magnetic field causes electrical currents to be induced within the drum, thereby reducing the concentrations of static charges on specific items of clothes.

The applicant has experimented with magnets in attempting to develop a static neutralizing device, and has found it difficult to figure the correct strength of magnet and the appropriate mounting location to achieve the maximum amount of static neutralizing effect. Also, locating a magnet in close proximity to an electric motor can adversely effect the operation of the motor, thus making the proper positioning of any magnets within the dryer more difficult. Applicant has also found that these types of devices do not entirely remove or neutralize the static charges from the clothes.

Other devices in the prior art use this same approach for neutralizing static charges—introducing a flow of electrons through the tumbling clothes—but do not use magnets. A device described in U.S. Pat. No. 3,161,479, uses the tumbler axle to rotate a belt which develops a static charge. This charge is then conducted through the metal drum to the clothes.

Another method of neutralizing static charges, described in the prior art, involves the discharge of either the positive or negative charges from the dryer drum through an electrical conductor. The clothes are left with a single polarity charge and will thereby repulse, rather than cling, to each other.

SUMMARY OF THE INVENTION

It is therefore a general object of the present invention to provide an improved device for discharging any build up of static electricity in a clothes dryer.

Another object of the instant invention is to provide a device which will continuously discharge static charges from clothes in a dryer drum during operation of the dryer.

A further object is to provide a static discharge device which is easily installed by the consumer on a conventional dryer.

Yet another object of the present invention is to provide a static discharge device of inexpensive manufacture and simple operation.

More generally it is an object of the present invention to provide a device for discharging static electrical charges from a clothes dryer, which includes a band of material which tends to give up electrons circumferentially mounted to the drum of the clothes dryer. A contact shoe with a layer of material which tends to tear away adjacent electrons is mounted to the side wall of the dryer with this material in frictional contact with the band. The contact shoe is electrically grounded, so that electrons which are collected by the layer of material and then transmitted to the contact shoe are continuously discharged through the ground.

These and other objects, advantages and novel features of the present invention will become apparent from the following detailed description of the invention when considered in conjunction with the accompanying drawings.

BEST MODE FOR CARRYING OUT THE INVENTION

Figure 1:
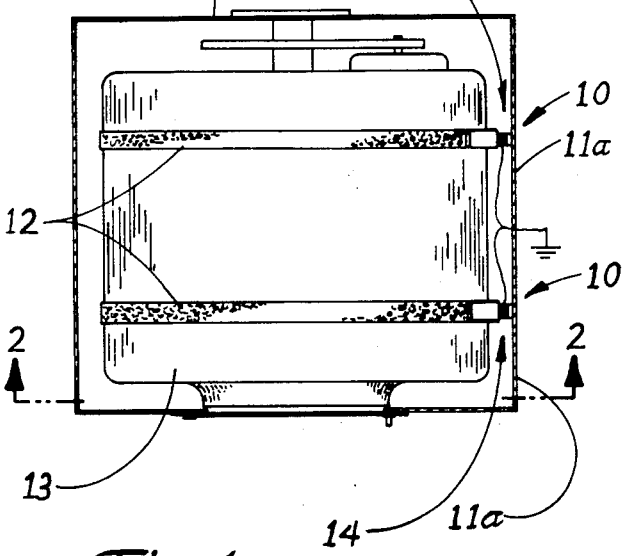
FIG. 1 is a top view of a clothes dryer with a static discharge device installed thereon, the walls of the clothes dryer being shown in section for viewing the interior.

Referring now to the drawings, in which identical or corresponding parts are indicated by the same reference character throughout the several views, and more particularly to FIG. 1, whereon each of a pair of static discharge devices is designated generally at 10 and shown mounted on dryer 11. Each device 10 includes a band 12 of material which tends to give up electrons, such as wool, affixed to the drum 13 of dryer 11, and a contact shoe assembly, designated generally at 14, mounted on a side wall **11*a* of dryer 11 so as to contact band 12. Although shown with a pair of static discharge devices 10, the invention will work equally well with a single device 10** of a larger size.

Figure 2:
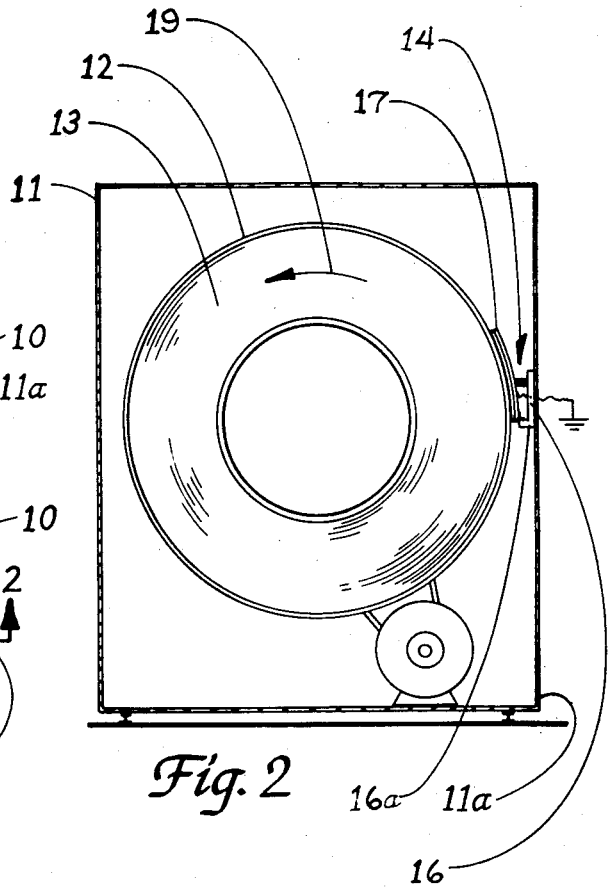
FIG. 2 is a front sectional view of the dryer with the device installed thereon taken at lines 2—2 in FIG. 1.
Figure 3:
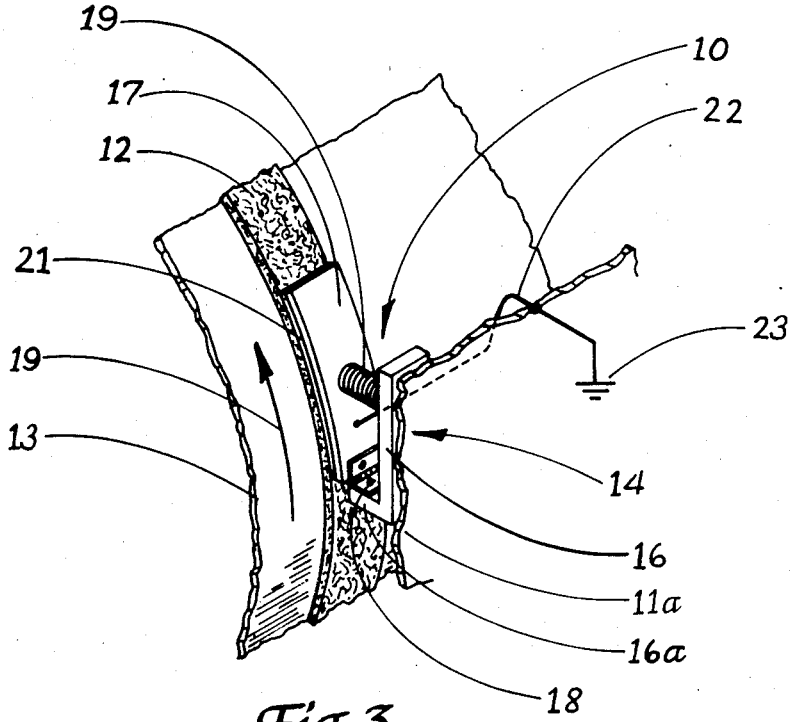
FIG. 3 is an enlarged partial perspective view of the static discharge device installed on a clothes dryer.

Referring now to FIGS. 2 and 3, each contact shoe assembly 14 includes a base 16 of electrically non-conductive material affixed to dryer sidewall **11*a*. Base 16 is a generally "L" shaped member, with the base leg 16*a* of the "L" projecting towards dryer drum 13. An electrically conductive shoe 17 is pivotally connected to the free end of base leg 16*a* using a hinge 18. Shoe 17 is generally rectangular in shape, and is slightly arcuate along its longitudinal axis so as to follow the general circumference of dryer drum 13. Shoe 17 is mounted for pivotal movement about a line parallel to the rotational axis of drum 13. The drum-adjacent face of shoe 17 has a layer of material 21** which tends to tear electrons away from adjacent atoms, such as leather, affixed to its face.

A compression spring 19 is connected between shoe 17 and base 16 so as to bias shoe 17 slightly towards drum 13. Only a slight force is utilized to keep shoe 17 in contact with drum 13, so that wear on the parts is kept to a minimum. Spring 19 will also allow for any inconsistencies in the surface of dryer drum 13. Contact shoe 17 will follow any slight projections or depressions in the surface of drum 13, insuring a constant and uniform contact therewith. It should also be noted at this point that contact shoe assembly 14 is preferably located such that drum 13 will rotate from the hinged end of shoe 17 towards the free end thereof, as shown by arrow 19. If the normal rotation of drum 13 is opposite that shown, then shoe assembly 14 should be mounted on the opposite sidewall of dryer 11. It should also be noted that device 10 could operate without spring 19 if shoe 17 were positioned such that gravity would bias it against drum 13.

A wire 22 is electrically connected at one end to shoe 17, and is connected at the other end to a ground 23.

When dryer 11 is operating, lint particles, clothing and dryer drum 13 will be in frictional contact. Due to the tendency of some materials to give up electrons and other materials to collect them, a static charge may be developed. This static charge is comprised of both positive and negative charges which will mutually attract one another. Thus, the clothing and particles with the opposing charges will cling, making the dryer less efficient, since the lint particles cannot be blown away.

The applicant has found that the generation of a static charge between drum 13 and an independently grounded contact shoe 17, can be successfully used to break down this attraction between the clothes, lint and drum. As shown at FIG. 3, rotation of drum 13 will cause band 12 to continuously rub against the leather layer 21 on shoe 17. The materials in leather layer 21 and wool band 12 were selected specifically to create a static charge when placed in frictional relationship. Obviously, other materials could be used, as long as one material readily gives up electrons and the other tends to tear them away.

In operation leather layer 21 on contact shoe 17 tends to tear away electrons from wool band 12 as frictional contact occurs during the rotation of drum 13. As the friction continues, shoe 17 builds up a negative charge and wool band 12 builds up a positive charge. Since contact shoe 17 is electrically grounded to a neutral source, the negative charge is continuously discharged, maintaining a neutral charge on shoe 17, and allowing it to continuously tear away electrons.

Band 12 will continue to build a positive charge as drum 13 rotates, which causes a greater and greater attraction to the negative charges in the clothes, lint and drum. The build up of positive charges in the band will finally induce the negatively charged clothes and lint particles to give up their "collected" electrons to band 12, causing band 12 to become neutrally charged. As drum 12 continues to rotate, the electrons transmitted to band 12 are again torn away by shoe 17, and discharged to ground 23. Thus, operation of dryer 13 will leave charges of only a single polarity in the lint, clothes and drum, breaking down any attraction which would have occured due to static electricity. Since the lint, clothes and drum will have charges of the same polarity, they will "oppose" each other. The clothes will tumble freely, and the lint can be removed easily from the clothes after removal from the dryer.

It will be readily understood that the particular disposition or arrangement or nature of the elements of the invention are not of the essence of the invention, and that many variations, substitutions, and modifications may be made, in departure from their particular construction and characterization in the drawings and foregoing description, without departing from the true spirit of the invention. It is therefore to be understood that the invention should be limited only by the breadth and scope of the appended claims.

What is claimed is:

1. A static discharge device for use on a clothes dryer, comprising:

a continuous band of material tending to give up electrons to adjacent atoms, attached to the exterior circumference of the drum of said clothes dryer;

a contact shoe of electrically conductive material mounted on one end to an electrically insulated base attached to said dryer, and located such that a portion of one face of said shoe is in frictional contact with said band;

a layer of material tending to tear away electrons from adjacent atoms, attached to the drum-adjacent face of said shoe and having dimensions greater than the area of contact between said shoe and band; and, a wire, electrically connecting said shoe to an independent ground, whereby electrical charges built up on said layer of material will be discharged through said shoe and wire to the ground.

2. The static discharge device of claim 1, wherein said shoe is mounted for pivotal movement on said base, the pivotal axis thereof being parallel to the rotational axis of said dryer drum and means for maintaining contact between the layer of material and the band of material.

3. The static discharge device of claim 2, wherein said contact maintaining means is a compression affixed between the shoe and the base.

4. The static discharge device of claim 3, wherein said shoe is arcuate along its longitudinal axis and generally follows the curvature of said dryer drum.

5. The static discharge device of claim 2, wherein said shoe is arcuate along its longitudinal axis and generally follows the curvature of said dryer drum.

6. The static discharge device of claim 1, wherein said shoe is arcuate along its longitudinal axis and generally follows the curvature of said dryer drum.

7. The static discharge device of claim 1, wherein said band of material is a blend of wool and rayon, and wherein said layer of material is leather.

* * * * *